US005438153A

United States Patent [19]

Chen

[11] Patent Number: 5,438,153

[45] Date of Patent: Aug. 1, 1995

[54] MUSIC BOX CAPABLE OF CAUSING A DOLL TO SWAY BACKWARDS AND FORWARDS

[76] Inventor: Joseph Chen, P.O.Box 82-144, Taipei, Taiwan

[21] Appl. No.: 302,274

[22] Filed: Sep. 8, 1994

[51] Int. Cl.[6] ..... G10F 1/06

[52] U.S. Cl. ..... 84/95.1; 446/298

[58] Field of Search ..... 84/94.1, 95.1, 94.2, 84/95.2; D17/24; 446/298

[56] References Cited

U.S. PATENT DOCUMENTS 5,081,899 1/1992 Hou et al. ..... 84/95.2

5,331,110 7/1994 Chen ..... 84/94.1

*Primary Examiner*—Michael L. Gellner

*Assistant Examiner*—Cassandra Spyrou

*Attorney, Agent, or Firm*—Alfred Lei

[57] ABSTRACT

A music box including a base, a seat fixedly mounted on the base and provided with a casing in which is fitted a spiral spring, a hitting member fixedly mounted on the seat and having a plurality of tines in contact with a drum, a disc rotatably connected with an end of the drum and formed with a hole near its circumference, a frame provided at one end with a leg fixedly mounted on the hitting screw by a screw, and an arm pivotally connected with another end of the frame and has a forked end at a lower portion, the forked end of the arm being movably connected with the disc by a pin engaged with the hole of the disc, a doll connected with an upper end of the arm, whereby the doll can be swayed backwards and forwards.

1 Claim, 4 Drawing Sheets

MUSIC BOX CAPABLE OF CAUSING A DOLL TO SWAY BACKWARDS AND FORWARDS

BACKGROUND OF THE INVENTION

It has been found that the conventional music box is simply a box with a mechanical device that produces a tune when the box is opened. However, such a music box is monotonous and too complicated in structure thereby increasing the cost thereof.

Therefore, it is an object of the present invention to provide a music box which may obviate and mitigate the above-mentioned drawbacks.

SUMMARY OF THE INVENTION

This invention relates to an improved music box.

It is the primary object of the present invention to provide a music box which can cause a doll to sway backwards and forwards.

It is another object of the present invention to provide a music box which is simple in construction.

It is still another object of the present invention to provide a music box which is compact in size.

It is still another object of the present invention to provide a music box which is economic to produce.

It is a further object of the present invention to provide a music box which is amusing and interesting.

The other objects and merits and a fuller understanding of the present invention will be obtained by those having ordinary skill in the art when the following detailed description is read in conjunction with the accompanying drawings wherein like numerals refer to like or similar part.

DETAILED DESCRIPTION OF THE PREFERRED EMBODIMENT

Figure 1:
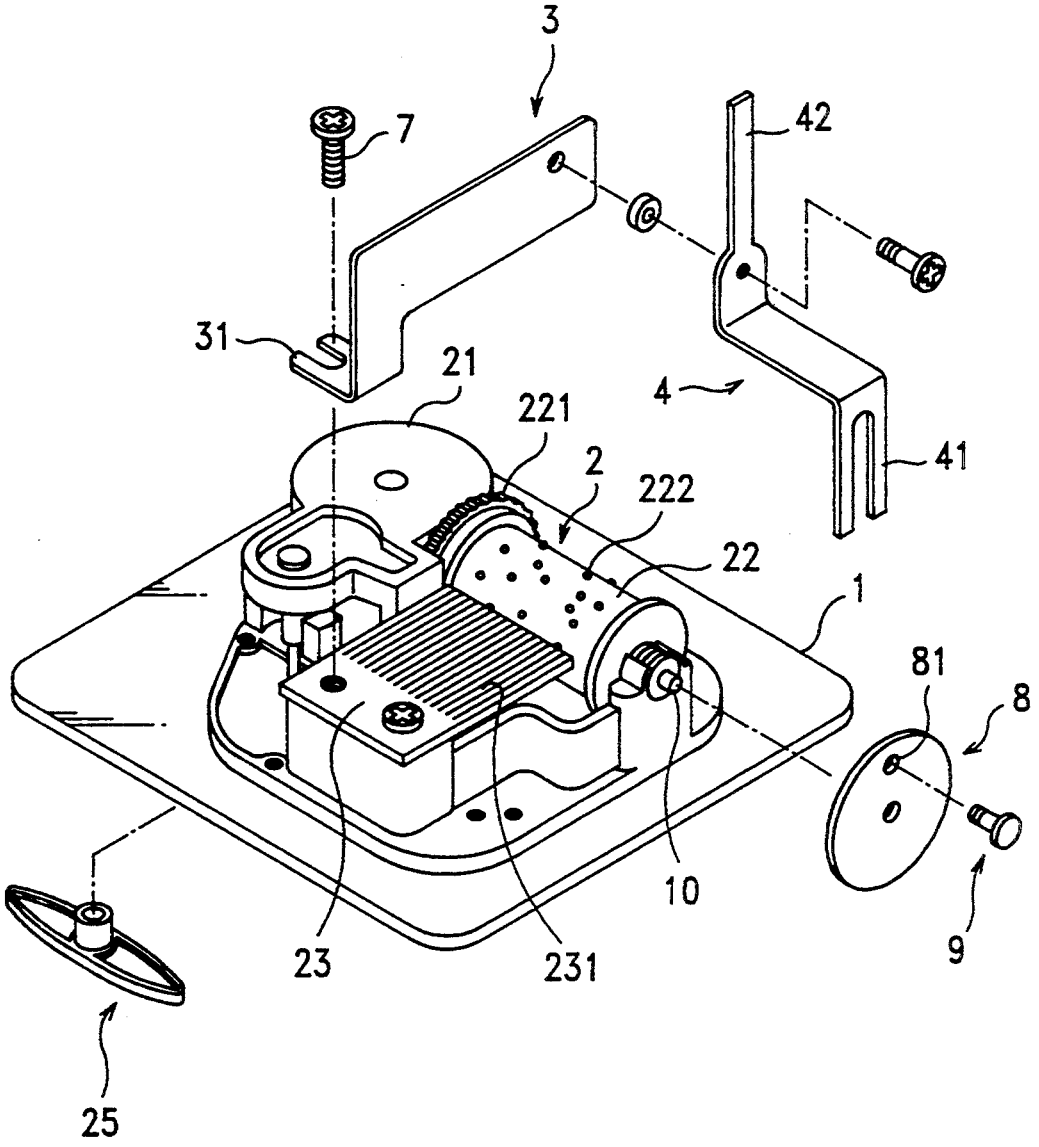
FIG. 1 is an exploded view of the present invention.

For the purpose of promoting an understanding of the principles of the invention, reference will now be made to embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIG. 1 thereof, the music box according to the present invention mainly comprises a base 1, a seat 2, a frame 3, an arm 4, a disc 8 and a doll 43.

As shown, the seat 2 is fixedly mounted on the base 1 by screws (not shown). On the seat 2 is mounted a casing 21 in which is fitted a spiral spring (not shown). The spiral spring is connected with a control lever 25 by means of which the spiral spring can be turned tight. The spiral spring is connected with a gear train (not shown) so that the spiral spring will drive the gear train to rotate. The gear train is in turn engaged with a gear 221 which is fixedly mounted on one end of a drum 22 formed with a plurality of protuberances 222 thereon. An axle 10 is connected with the gear 221 so that the axle 10 will be rotated therewith. A hitting member 23 having a plurality of tines 231 is fixedly mounted on the seat 2, with its tines 231 contacting the surface of the drum 22. A disc 8 is rotatably connected with the other end of the drum 22 and is formed with a hole 81 near its circumference.

The frame 3 is provided at one end with a leg 31 fixedly mounted on the hitting member 23 by a screw 7.

Figure 2:
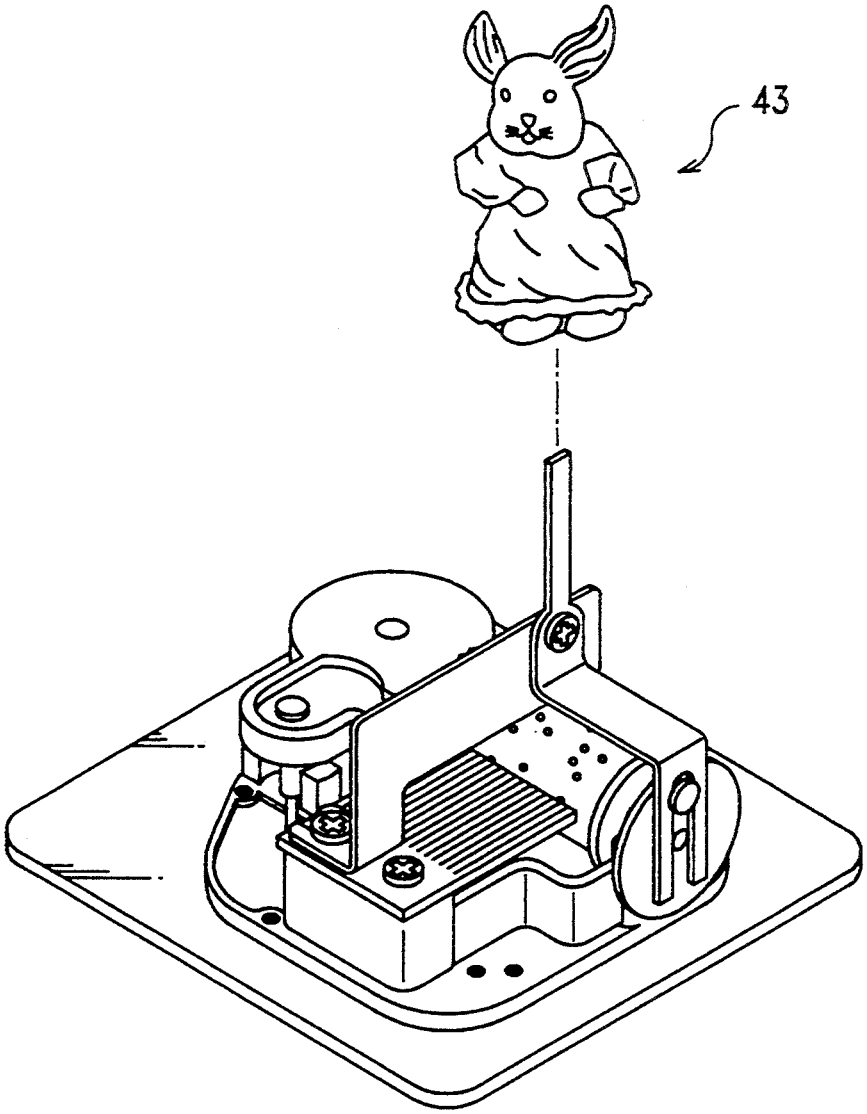
FIG. 2 is a perspective view of the present invention.
Figure 3:
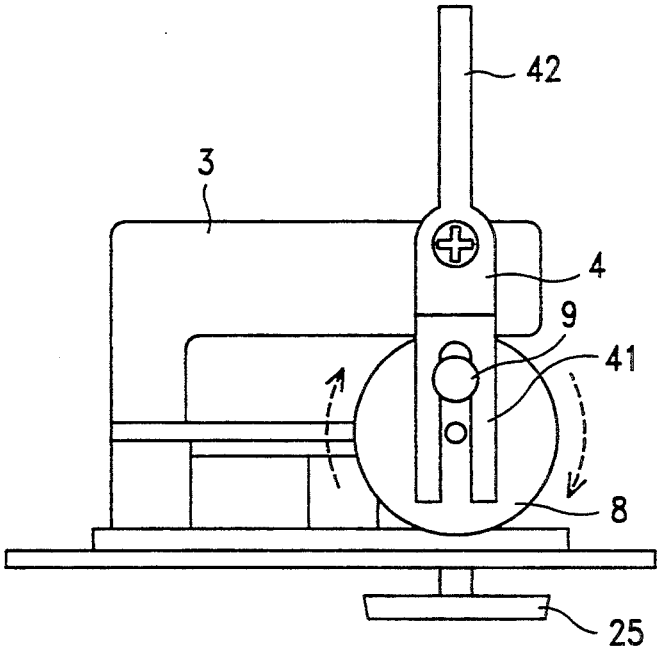
FIGS. 3, 4, 5 and 6 show the working principle of the present invention.
Figure 4:
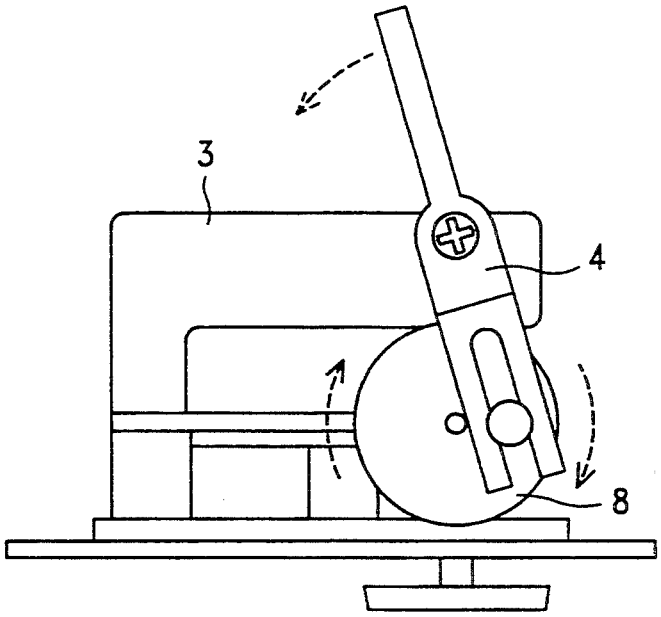
Figure 5:
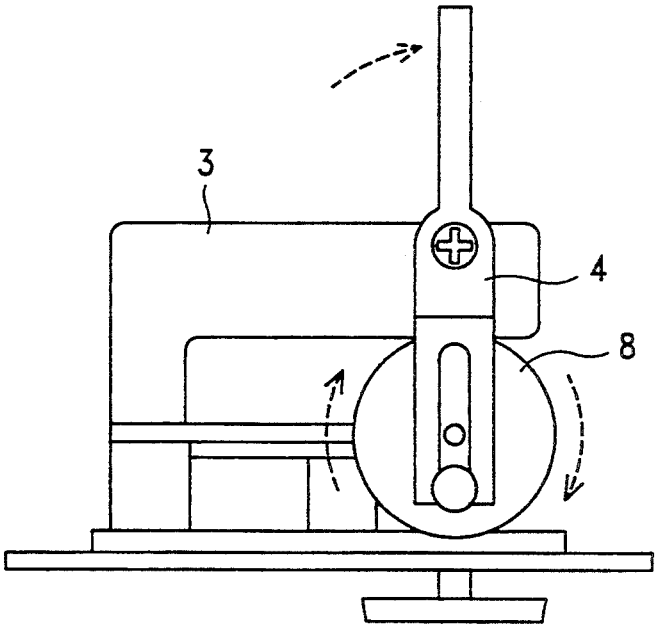
Figure 6:
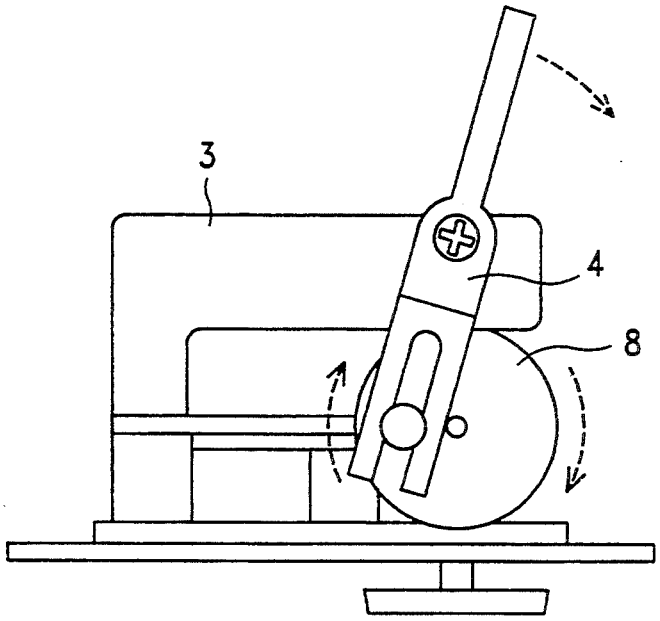

The arm 4 is pivotally connected with another end of the frame 3 and has a forked end 41 at the lower portion. The forked end 41 of the arm 4 is movably connected with the disc 8 by a pin 9 engaged with the hole 81 of the disc 8. The upper end 42 of the arm 4 is connected with a doll 43 (see FIG. 2).

Referring to FIGS. 3, 4, 5 and 6, there is shown the working principle of the present invention. When desired to produce music, simply turn the control lever 25 to turn the spiral spring tight and then release the control lever 25. Then, the spiral spring will drive the gear train which will in turn drive the gear 221 thereby rotating the drum 22. As the drum 22 is rotated, the tines 231 of the hitting member 23 will hit the protuberances 222 of the drum 22 hence producing music. In the meantime, the gear 221 will rotate the axle 10 which will in turn rotate the disc 8. As the disc 8 is rotated, the pin 9 will drive the forked end 41 of the arm 4 to oscillate thereby swaying the doll 43 backwards and forwards.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A music box comprising:

a base;

a seat fixedly mounted on said base and provided with a casing in which is fitted a spiral spring, said spiral spring being connected with a control lever and a gear train, said gear train being engaged with a gear fixedly mounted on an end of a drum provided with a plurality of protuberances thereon;

a hitting member fixedly mounted on said seat and having a plurality of tines in contact with said drum; and a disc rotatably connected with another end of said drum and formed with a hole near a circumference thereof;

the improvement comprising a frame provided at an end with a leg fixedly mounted on said hitting member by a screw, an arm pivotally connected with another end of said frame and has a forked end at a lower portion, the forked end of said arm being movably connected with said disc by a pin engaged with the hole of said disc, and a doll connected with an upper end of said arm.

* * * * *